United States Patent [19]

Kubo et al.

[11] 4,305,452

[45] Dec. 15, 1981

[54] METHOD OF PRE-HEATING BOILER FEED WATER

[75] Inventors: Junichi Kubo, Muroran; Shuma Sasaki, Yokohama; Kutuhiko Sasaki, Muroran; Tatsuo Omata, Matsudo, all of JPX

[73] Assignee: Nippon Petroleum Refining Co., Ltd., Tokyo, Japan

[21] Appl. No.: 176,722

[22] Filed: Aug. 8, 1980

[30] Foreign Application Priority Data

Aug. 23, 1979 [JP] Japan ..... 54-108009

[51] Int. Cl.[3] ..... F28F 13/18

[52] U.S. Cl. ..... 165/1; 122/1C; 122/401; 122/412; 122/DIG. 13; 165/133

[58] Field of Search ..... 165/1, 133; 122/1 C, 122/412, 398, 401, 4 R, 420, 403, DIG. 13; 208/368

[56] References Cited

U.S. PATENT DOCUMENTS

| | | | |
|---|---|---|---|
| 1,336,360 | 4/1920 | Lummus | 208/368 |
| 2,623,506 | 12/1952 | Dahn et al. | 122p/412 |
| 2,681,885 | 6/1954 | Briggs | 122/398 X |
| 3,809,155 | 5/1974 | Anthony et al. | 165/133 |
| 4,075,376 | 2/1978 | Jaeger | 165/133 X |
| 4,173,949 | 11/1979 | Roethe | 122/412 |
| 4,231,422 | 11/1980 | Moranne | 165/133 X |

*Primary Examiner*—Edward G. Favors

*Attorney, Agent, or Firm*—Jordan and Hamburg

[57] ABSTRACT

A method of pre-heating feed water for boilers is disclosed which utilizes the exchange of heat between the tube side of a heat-exchanger which contains de-salinated and de-ionized water and the shell side which contains hydrocarbon vapors boiling in the range of 90° to 150° C. The tubes are made of carbon steel with their outer surfaces aluminized.

3 Claims, No Drawings

METHOD OF PRE-HEATING BOILER FEED WATER

BACKGROUND OF THE INVENTION

1. Field of the Invention

This invention relates to a method of pre-heating boiler feed water, in which effective use is made of a low temperature range of heat generated from petroleum refineries without involving equipment corrosion.

2. Prior Art

Heretofore, such vapors of hydrocarbon fractions boiling in a range of gasoline as may be obtained by straight-run or catalytic cracking of crude oil normally have a temperature ranging from 90° C. to 150° C. Since recovery of heat from such low temperature hydrocarbon vapors is difficult and such vapors are required to be liquefied by cooling, there have generally been used heat-exchangers or condensers for cooling and liquefying the vapors with use of sea water. In such instance, various copper alloys such as aluminum-brass, naval-brass and the like have been employed for the condenser tubing from the standpoint of necessity for preventing the tubing from corrosion in contact with sea water. Most heat generated in the equipment has been simply discarded.

On the other hand, boiler feed water has been generally provided by filtering water for industrial use, pre-heating or heating pure water which has been de-salinated and de-ionized through filtration, then introducing the same into a deaerating vessel at a temperature of about 100° to 130° C. to remove air and oxygen dissolved in the pure water prior to feeding the boiler. Pre-heating has been effected usually with use of hot steam. However, since intake water is near room temperature or much lower temperature during the winter season, a great deal of heat is required to pre-heat the water to a desired level of temperature.

SUMMARY OF THE INVENTION

It is therefore the primary object of the present invention to provide an improved method of pre-heating the boiler feed water by utilizing a source of heat readily available at petroleum refineries and yet with equipment corrosion reduced to an absolute minimum.

According to the present invention, in the general aspect thereof, there is provided a method of pre-heating boiler feed water which comprises supplying de-salinated and di-ionized boiler feed water into the tube side of a heat-exchanger, the tubes being made of carbon steel with aluminized outer surfaces, supplying hydrocarbon vapors boiling in the range of gasoline between 90° C. and 150° C. into the shell side of the heat exchanger, and preheating the boiler feed water by means of heat generated in the heat-exchanger prior to introduction into a deaerating vessel for the boiler.

DETAILED DESCRIPTION OF THE PREFERRED EMBODIMENTS

Hydrocarbon vapors boiling in the range of gasoline as referred to herein include mineral oil fractions normally boiling in the range of 30° to 200° C., typical examples of which are available from fractional distillation of crude oil or from thermal decomposition and catalytic cracking of relatively heavy hydrocarbons having a boiling point above kerosene and light oil such as those obtained overhead from a distillation column and gaseous at a temperature of 90° to 150° C. or more usually 100° to 130° C. Such hydrocarbon vapors may contain therein gases such as, for example, CO, $CO_2$ and $N_2$ and hydrocarbon gases of one or four carbons such as for example methane, ethane, propane, butane and the like, and may even contain sulfur compounds such as hydrogen sulfide, mercaptans and the like as well as chlorides such as hydrogen chloride (HCl) produced by thermal decomposition of for example $MgCl_2$, $CaCl_2$ and the like. In some cases, there may be further added basic materials such as ammonia to neutralize these acidic compounds.

Such hydrocarbon vapors have heretofore been cooled and condensed by means of heat-exchangers using sea water. In such instance, the heat-exchanger tubes are usually made of an expensive copper alloy such as aluminum-brass or naval-brass with a view to preventing the tubes from corrosion.

According to the present invention, it has now been found that such copper alloy tubing can be substituted satisfactorily by carbon steel tubing with aluminized outer surfaces which is free from corrosion or stress cracking which would otherwise occur with copper alloy tubing in the presence of impurities in the hydrocarbon vapors. The use of pure water unlike sea water prevents corrosion of the interior walls of the tubing.

The carbon steel tubing according to the present invention is aluminized exteriorly by means such as of hot dipping, metal spraying, diffusion or electro-plating. The tube ranges in wall thickness usually from 1.6 to 2.7 mm and in diameter usually from 19 to 25.4 mm. No particular restriction is imposed on the material of the shell which may be carbon steel or aluminized carbon steel, as the case may be.

In the present invention, de-salinated and de-ionized boiler feed water is supplied in the manner in which the water becomes turbulent within the tubing. Tube pressure may be atmospheric or higher, but should be maintained higher than the pressure of the shell of the heat-exchanger so as to prevent hydrocarbons from getting into the boiler feed water in the event of damage of the tubes. The boiler feed water is usually pure water of about room temperature which is generally obtained by filtering industrial water and de-salinating and de-ionizing the same in an ion-exchanger.

According to the method of the present invention, the boiler feed water is pre-heated to approximately 50° to 120° C. on passage through a heat-exchanger and supplied as it is or, after further being heated, to a boiler deaerating vessel.

At the same time, hydrocarbon vapors of the class already described are supplied at a temperature of from 90° to 150° C. to the shell side of the heat-exchanger, whereby the vapors are cooled, most part of which is condensed into liquid for removal from the heat-exchanger. Part of the resulting liquid hydrocarbon may be recycled as reflux to the top of a distillation column, or may be used per se as a final or an intermediate product.

A choice of the capacity of heat-exchangers or the number and length of their tubes depends upon the temperature and quantity of the boiler feed water to be supplied, the temperature and quantity of the hydrocarbon vapor, and the temperature of pre-heated feed water. A plurality of heat-exchangers can of course be used either in parallel or in series.

The advantages accruing from the practice of the present invention may be enumerated as follows:

(1) Heat in a low temperature range can be recovered for effective use.

(2) Corrosion of heat-exchangers is reduced to an absolute minimum, thereby facilitating the maintenance of the equipment and enhancing heat recovery.

(3) Pre-heating of boiler feed water is effected with the use of heat in a low temperature range.

(4) Hydrocarbon vapors in the boiling range of gasoline can be effectively liquefied and cooled without use of sea water or other cooling medium.

(5) Since pure water is used for the heat-exchanger, its tubing is substantially free from fouling and hence, good conduction of heat is maintained.

(6) The use of surface-aluminized carbon steel for the heat-exchanger tubing adds to economy and high heat conductivity.

The invention will be further described with reference to the following example.

EXAMPLE

Two units of heat-exchangers were installed in parallel, into which was introduced pure water of 15° C. at a rate of 240 tons per hour which had been de-salinated and de-ionized with an ion exchange resin. Each heat-exchanger contained a total of 800 carbon steel tubes measuring 6 m in length, 19 mm in diameter and 2.1 mm in wall thickness, the outer surface of which was aluminized. Hydrocarbon vapors at a temperature of 130° C. were supplied into the shell side of the heat exchanger at a rate of 50 tons per hour. The hydrocarbon vapors consisted of a fractionated component having a boiling range of gasoline between 30° to 210° C. and light hydrocarbon gases available from the top of a distillation column having a catalytically cracked product of light oil, the gases containing some ammonia, $H_2S$, mercaptan phenol and other impurities.

From the outlet of the tube side of the heat-exchanger, there was obtained preheated pure water of 50° C. which was further heated and supplied into a deaerating device for the boiler. From the outlet of the shell side, there were obtained hydrocarbons and light hydrocarbon gases in the boiling range of liquid gasoline which had been cooled to a temperature of 30° C. The operation of the heat-exchangers was continued for 9,000 hours, without any appreciable corrosion encountered.

For the sake of comparison, BSTF (aluminum-brass) tubing was used for the heat-exchanger, in which instance considerable rupture due to stress corrosion was noted at the outer surface of the tubing, while the inner surface of the tubing was badly corroded by sea water.

Further for purposes of comparison, preheating was conducted with hydrocarbon vapors cooled and condensed according to the conventional method using sea water, when it was required to use 500 tons per hour of sea water and 10 tons per hour of steam for preheating the boiler feed water with 200° C. steam.

What is claimed is:

1. A method of pre-heating boiler feed water which comprises: supplying de-salinated and de-ionized feed water into the tubing of a heat-exchanger, said tubing being made of carbon steel with the outer surface thereof aluminized; introducing hydrocarbon vapors in the boiling range of gasoline of a temperature ranging from 90° to 150° C. into the shell side of said heat-exchanger to cool and condense said hydrocarbon vapors; and pre-heating said feed water with heat resulting from the cooling and condensing of said vapors prior to its supply to a deaerating device for the boiler.

2. The method according to claim 1 wherein said feed water is held turbulent within the tubing of the heat-exchanger.

3. The method according to claim 1 wherein the heat-exchanger is held at a pressure greater at the tube side thereof than at the shell side.

* * * * *